US005855304A

United States Patent [19]

Dean et al.

[11] Patent Number: 5,855,304

[45] Date of Patent: Jan. 5, 1999

[54] PAINT CAN

[76] Inventors: Richard A. Dean, 6699 Via Estrada, La Jolla, Calif. 92037; Tharold Eugene Northup, 14706 High Valley Rd., Poway, Calif. 92064

[21] Appl. No.: 741,695

[22] Filed: Oct. 31, 1996

Related U.S. Application Data

[63] Continuation-in-part of Ser. No. 383,447, Feb. 3, 1995, abandoned.

[51] Int. Cl.[6] ..... B67D 3/00

[52] U.S. Cl. ..... 222/481; 222/481.5; 222/531; 222/533; 222/553; 220/570; 220/694

[58] Field of Search ..... 222/481, 481.5, 222/482, 522, 531, 533, 545, 553, 567, 570, 572; 220/212, 570, 694, 733

[56] References Cited

U.S. PATENT DOCUMENTS

| | | | |
|---|---|---|---|
| 310,051 | 12/1884 | Harker et al. | 222/481 |
| 1,376,103 | 4/1921 | Krogmann | 222/481 |
| 1,943,314 | 1/1934 | Hothersall | 222/481 |
| 2,660,333 | 11/1953 | Paxton | 220/733 |
| 2,772,037 | 11/1956 | Rieke | 222/481 |
| 2,960,257 | 11/1960 | Sasse | 220/733 |
| 4,781,214 | 11/1988 | Schoonover et al. | 222/282 |
| 4,893,723 | 1/1990 | Seabolt | 220/570 |
| 4,911,319 | 3/1990 | DeJean | 220/733 |
| 5,358,148 | 10/1994 | Hanifl et al. | 222/481 |

FOREIGN PATENT DOCUMENTS

| | | | |
|---|---|---|---|
| 9002159 | 5/1992 | Netherlands | 222/572 |

*Primary Examiner*—Joseph A. Kaufman
*Attorney, Agent, or Firm*—John R. Ross; John R. Ross, III

[57] ABSTRACT

A can for holding paint and similar products. The can has a rectangular bottom, preferably square, and rectangular sides providing a space savings of about 20 percent as compared to round cans. It has a main opening large enough to permit passage of large paint brushes or sprayer suction lines and filters. This opening is covered with a large cap. A swivel pour valve permits paint to be poured from the can in a controlled manner with no spillage or mess. In a preferred embodiment, the swivel pour valve is an integral part of the large cap covering the large opening. The can is preferably made of plastic which eliminates problems of rust and other corrosion problems.

9 Claims, 8 Drawing Sheets

PAINT CAN

This is a continuation-in-part application of Ser. No. 08/383,447, filed Feb. 3, 1995 now abandoned. The present invention relates to cans and in particular to paint cans.

BACKGROUND OF THE INVENTION

Paint normally is supplied for the home use retail market in ½ pint, pint, quart and 1 gallon cylindrical metal containers formed of metal with removable tops. The removable tops of 1 gallon and smaller cans have a convoluted rim that is press fit into a matching rim, to form a tight seal. Paint poured from these cans into other containers (smaller cans, paint roller pans, etc.) for more efficient use, flows over and into the convoluted edge which inevitably contaminates the sealing area and runs down the side of the can and often on to work area forming a paint ring where the can sits. When a paint brush is dipped into the can and then drug across the curved rim area, paint also gets into the sealing area. Upon resealing the can, this contamination can result in a less than airtight seal and the remaining paint may dry out during storage. Due to the configuration of the top convoluted edge of the can being located radially inward from the periphery, it is difficult to get all of the paint poured out causing waste and disposal concerns.

Paint is also sold in larger containers such as a standard 5 gallon metal or plastic container. The lids of these containers are often provided with a small removable seal cap. Paint can be poured from the 5 gallon can through the seal cap or by removing the complete lid. This contaminates with paint the top area around the seal cap and usually the side of the can. Paint can also be removed from the 5 gallon cans with power suction lines. Insertion of the suction lines and strainers usually requires the complete top of a 5 gallon can to be removed which breaks the seal.

Unused paint is usually stored in its original can. Repeated opening and closing of the top gradually reduces the sealing capability allowing air and moisture to enter or paint to seep out when can is upset. Each repeated opening becomes more difficult to effect a tight seal. The external surfaces of the I gallon and smaller cans easily rusts when exposed to humid conditions. Since the convoluted seal is not very tight due to paint and rust contamination, moisture gets inside the can which causes rusting and contamination of the remaining good paint unless rust prevention interior coatings are used. This rusting in the rim area also makes it difficult to subsequently remove the top, and after only a few openings, pliers are usually required. Liquid paint left in the convoluted seal as a result of pouring inevitably splatters when the top is pressed or hammered into place.

The cylindrical shape of any can of any size does not provide for economical shipping and storage of paint. One gallon cans are usually shipped in cardboard boxes, 4 to a box. Up to about 27% of the available shipping space is not used. One and 5 gallon cans are stored and displayed in stores and warehouses in stacked columns with up to about 27% wasted space.

Many adapters have been devised for attachment to the top of paint cans. These have had only limited success in solving the problems discussed above.

Water coolers with swivel pour valves are commercially available, and many square cans made of both plastic and metal are used commercially for the containment of a great variety of products.

What is needed is an effective clean paint can. Such a can should be capable of providing a means for discharging all of its contents by power spray equipment or in a narrow controllable stream, without concern for drips, runs, spills or contamination of sealing surfaces, loss of sealing capability with each opening and closing, waste of paint left in can, spattering during replacement of the top, corrosion contamination during storage, loss of shipping and storage space, access by power paint spraying suction lines and strainers, and storage of unused paint with minimum concern for messy spills, drips, contamination and subsequent loss of contents. It should be opened and resealed without the need for screwdrivers, pliers or hammers.

SUMMARY OF INVENTION

The present invention provides a can for holding paint and similar products. The can has a rectangular bottom, preferably square, and rectangular sides providing a space savings of about 20 percent as compared to round cans. It has a main opening large enough to permit passage of large paint brushes or sprayer suction lines and filters. This opening is covered with a large cap. A swivel pour valve permits paint to be poured from the can in a controlled manner with no spillage or mess. In a preferred embodiment, the swivel pour valve is an integral part of the large cap covering the large opening. The can is preferably made of plastic which eliminates problems of rust and other corrosion problems.

The present invention provides paint cans with substantial advantages over prior art paint cans. These advantages include a no drip spout which can pour as little as one ounce without a drip. The can can be opened and closed without tools. There is no lid seal which deteriorates with repeated openings. There is no contamination of sealing surfaces or can exterior with use. There is no corrosion of a lid seal or inside of the can. The can comprises a straight brush wipe so that paint from the brush drips back into the can. The can is easily resealable after using spray nozzles. The square can permits 20 percent more paint volume for shipping and storage. The can can be completely emptied without spilling. The can is stackable without orientation. The can is more stable than prior art paint cans and is less likely to be overturned. The design is suitable for small, medium and large cans.

BRIEF DESCRIPTION OF THE DRAWINGS

FIG. 13 A is a section view of a portion of the FIG. 11 embodiment.

DETAILED DESCRIPTION OF PREFERRED EMBODIMENTS

First Preferred Embodiment

Paint Can

Figure 1:
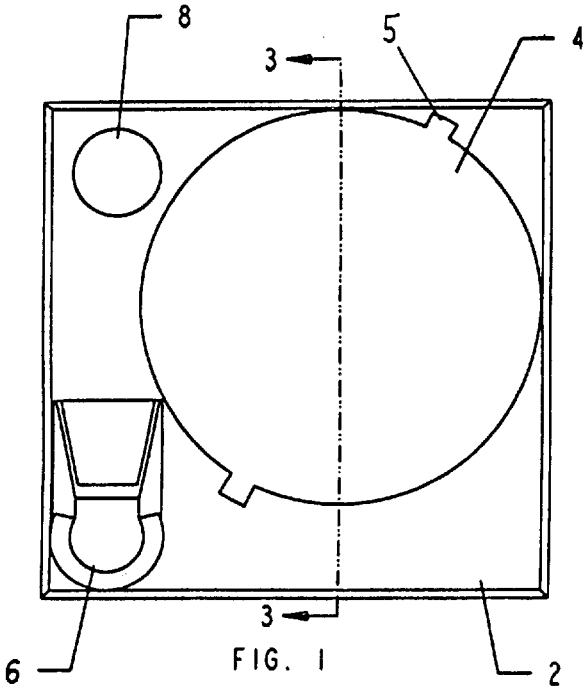
FIGS. 1, 2 and 3 are views of a preferred embodiment of the present invention.
Figure 2:
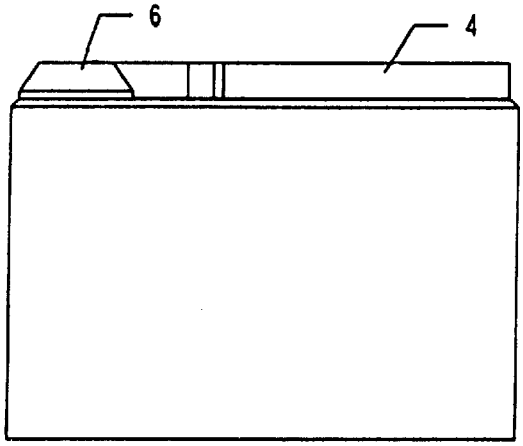
Figure 10:
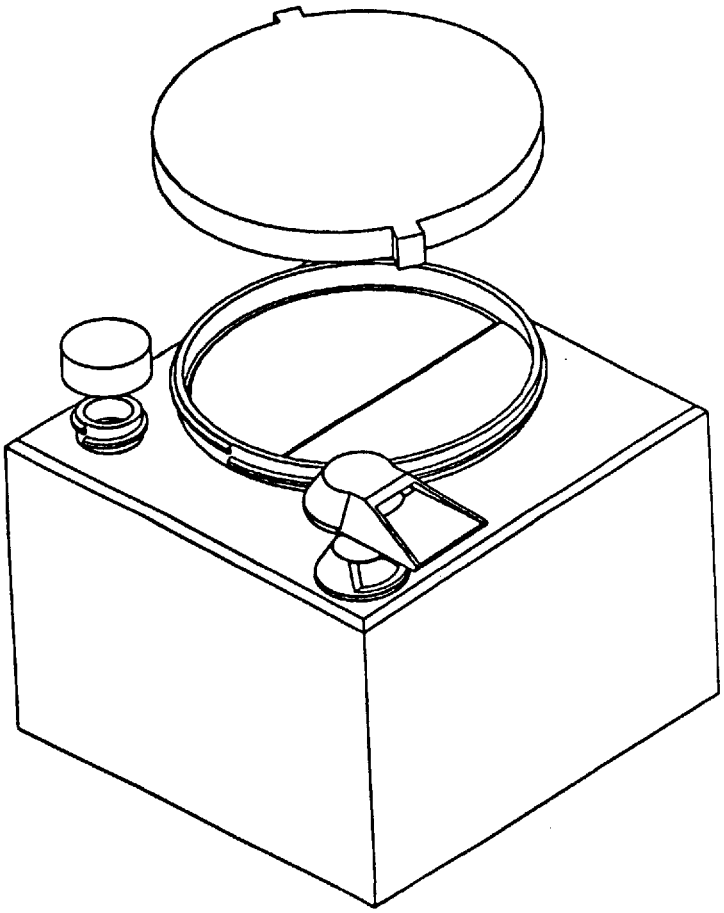
FIG. 10 is an exploded view of the above paint can.

A preferred one gallon embodiment of the present invention can be described by reference to the figures. FIG. 1 shows the top view of this embodiment and FIG. 2 shows a side view. An exploded view of the can is shown in FIG. 10. This embodiment is injection molded from polyethylene plastic. There are four parts to the can: can body 2, main cap 4, pour valve 6 and vent cap 8.

Can Body

Figure 3:
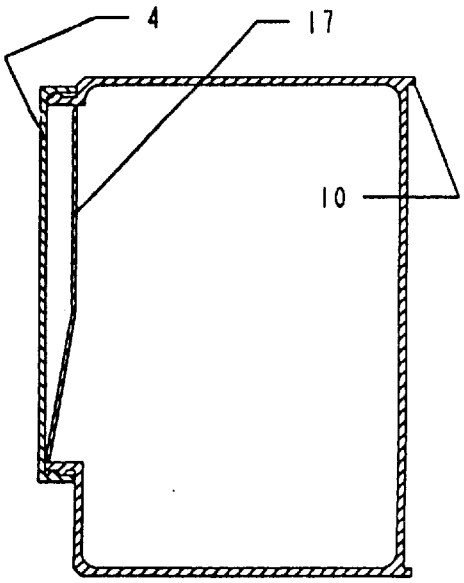
Figure 9:
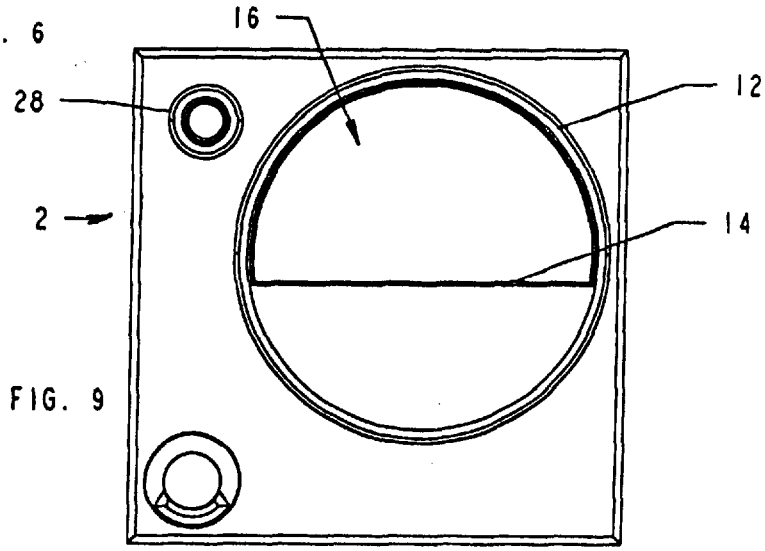
FIG. 9 is a drawing of the body of the embodiment shown in FIGS. 1, 2 and 3.

The can has a square bottom, 7½ inch on a side (inside dimension) and is approximately 6 inches high. FIG. 3 is a section view through the center of main cap 4. A bottom lip 10 is shown on FIG. 3. The lip provides for a snug fit against the edges of the caps on the tops of other cans for good stacking of the cans. FIG. 9 is a top view of of can body 2 with all caps removed. Main cap lip 12 provides a 360 degree screw thread for a matching thread on main cap 4. A straight edge 14 is provided in main opening 16 for paint brush wiping when brush painting directly from the can. A sealing diaphragm 17 comprised of 1/16 inch polyethylene is provided within main opening 16 to reduce the risk of leakage prior to use.

Main Cap

Main cap 4 is a molded polyethylene cap. It has a 360 degree thread matching the thread on lip 12. The cap comprises two boss protrusions 5 positioned 180 degrees apart on the circumference of the cap to aid in opening the cap.

Pour Valve

Figure 5:
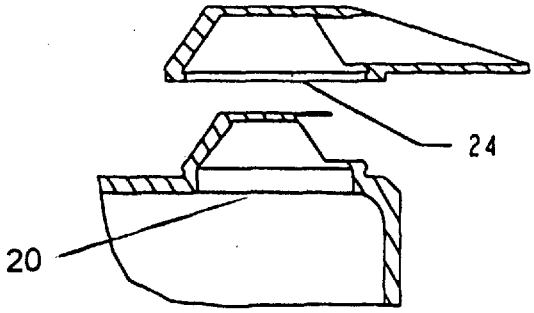
FIGS. 5 and 6 show details of the swivel valve.
Figure 6:
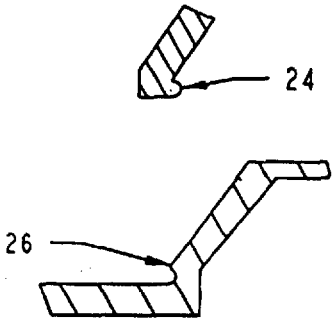
Figure 4:
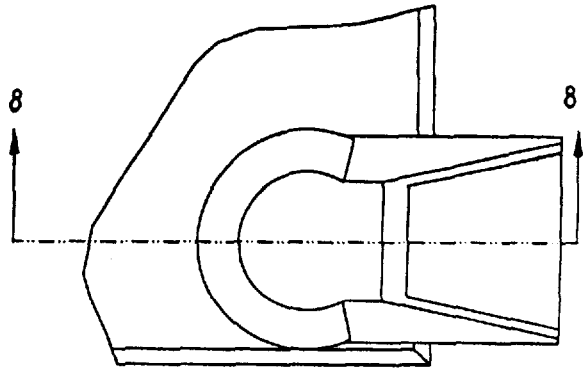
FIG. 4 is a drawing of a swivel valve used on the above embodiment.
Figure 7:
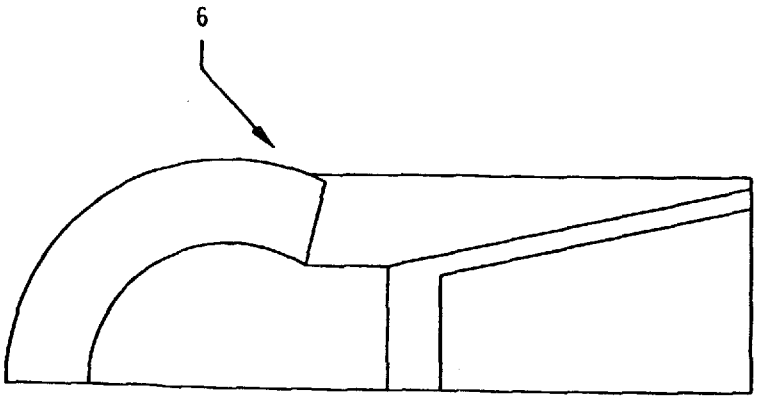
FIGS. 7 and 8 are more views of the swivel valve.
Figure 8:
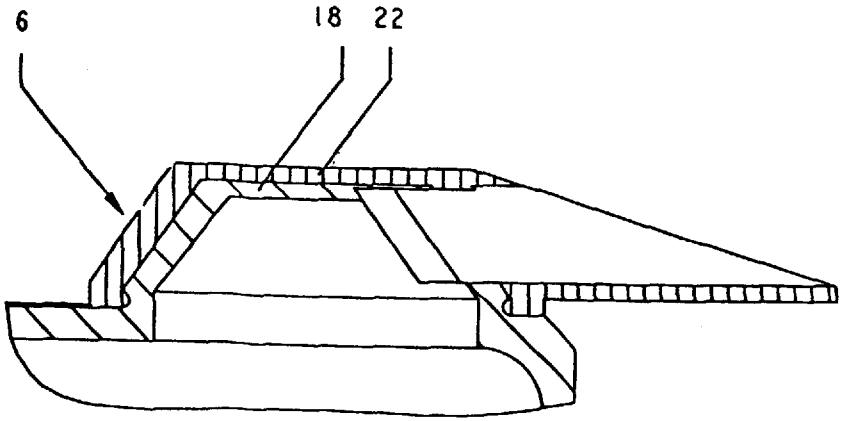

Pour valve is shown in greater detail in FIGS. 7, 8 and 4. An exploded view of the two principal elements of the valve is shown in FIG. 5 which is an exploded section view in the direction shown in FIG. 4 with the valve in its full open pouring position. The valve base 18 of pour valve 6 is shown in FIG. 5 and is molded as an integral part of can body 2. The base portion provides a 1¾ inch diameter opening in the top of can body 2 and a 7/16 inch high trapezoidal shaped valve opening as shown in FIG. 5. Pour cap 22 snap fits on to valve base 18 as shown in FIG. 5 and FIG. 8. The inside dimensions of pour cap 22 are substantially equal to the outside dimensions of base 18 within fabrication tolerances of about 1/64 inch. Snap fit is provided by snap ring 24 which has an inside diameter of 1 9/16 which is 1/32 inch smaller than the 1 19/32 inch diameter of groove 26 on base 18 and 1/16 smaller than the diameter of the base at lip 26 as shown on FIG. 6. A knock out diaphragm of polyethylene film is also provided over valve opening 20 to assure no leakage prior to use.

Vent Cap

Vent cap 8 is a standard threaded polyethylene cap. The male threaded lip for the cap is molded as an integral part of can body 2 as shown at 28 in FIG. 9. As with the other openings in the can body this opening is also provided with a polyethylene diaphragm cover to prevent leakage prior to use. Colors can be added to neutral colored paint at retail sales facilities through the vent cap.

Can Features

The special features of this embodiment of the present invention provides some very important improvements over prior art paint cans. Following are some of the advantages of this embodiment over standard commercially available paint cans: Square versus round shape permits about 20% more paint to be shipped and stored in same volume of space. Paint can be poured from the can with no corners, edges, rims or other features obstructing the full flow and complete emptying of can. External screw thread access cap provides repeatable closings without fatigue and gradual loss of sealing capability or contamination of the threads with paint. A 5½ inch minimum opening allows a 4-inch brush and a power paint spray suction line to be easily inserted into the can interior without cutting holes or breaking tabs (i.e. without damaging can). The large screw cap has two boss protrusions on cap edge located 180 degrees apart and over the top of the can to facilitate opening. Openings have break-out diaphragms to prevent spills during shipping and storage prior to use. The screw vent cap is provided for color mixing of base color paints. After removal of a break-out portion of the large diaphragm seal, a paint brush straight edge wiper remains, slopping towards the center of the opening for paint from brush wipe to drain back into can. Raised threaded sealing rim at the large opening allows stirring of the contents without spilling or contaminating sealing surfaces. Since paint can be poured from a smaller drip-less spout, paint does not need to flow over large opening screw threads thereby preventing contamination. The screw lid eliminates spattering of paint upon resealing. Valve pour cap 6 allows for very controlled pouring of paint without spills or contamination and easy resealing of the opening by simply rotating the cap 180 degrees or less. Smooth pouring out of drip-proof spout prevents dripping of paint outside of can. Valve pour cap 6 can be turned from full open to partially open to regulate the flow out of the can. Vent cap can be loosened to break vacuum during pours. The bottom/top configuration of the can provides easy stacking regardless of orientation. The can can be reused for handling other liquids besides paint with many of the same advantages as discussed above. The size (volume) can be easily adjusted in manufacturing for any capacity of contents without changing concept and by adjusting size of openings. Use of material, such as plastic, to construct the can results in it being chemically resistant to and not naturally affected by paints, enamels, lacquers, sealers, thinners, glues, alcohols, and other conventional, commercial, and industrial cleaners, solvents and solutions on which the invention would have application. Use of material, such as plastic, eliminates rusting. Material and material thickness can be easily selected to render said can sufficiently rigid to contain density of material without sagging deflections and to allow stacking equal to current containers. Plastic materials such as polyethylene or polyvinyl chloride should preferably be fluorine gas-treated to make it impervious to oil-based solvents and molded to appropriate shapes using any of several well known plastic molding techniques such as blow molding or injection molding.

Second Preferred Embodiment

Figure 11:
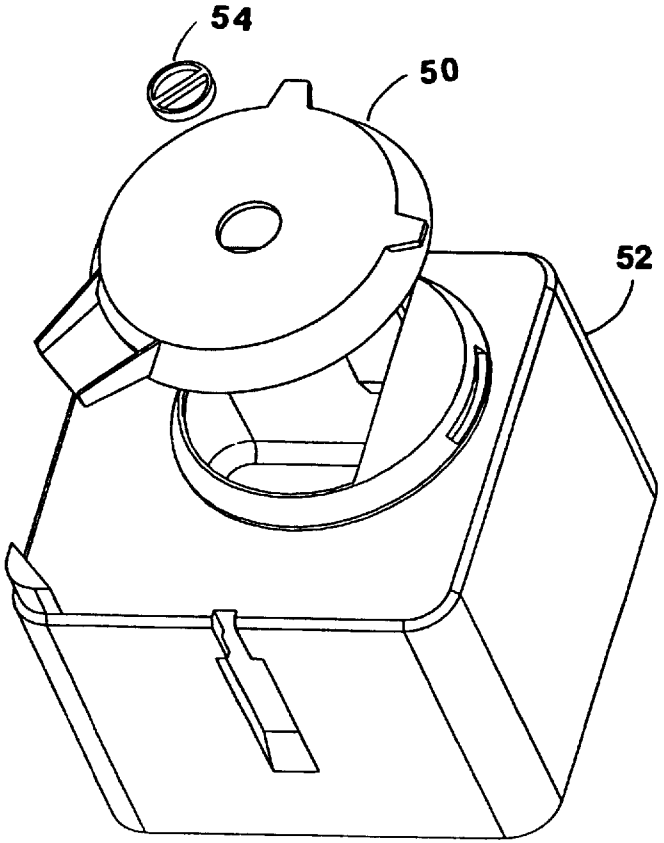
FIG. 11 is an exploded view of a second preferred embodiment of the present invention
Figure 13A:
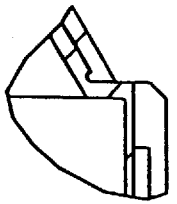
FIG. 13 is a cross section view of the FIG. 11 embodiment.
Figure 13:
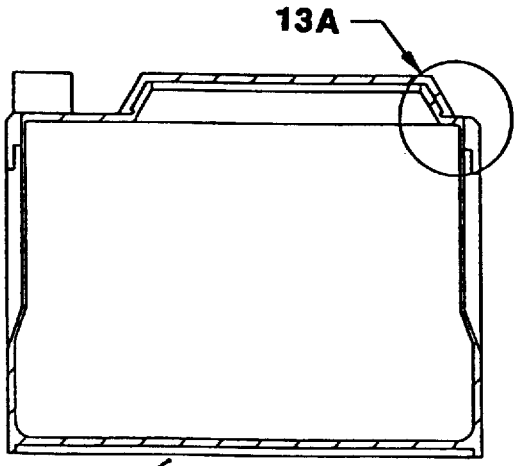
Figure 12:
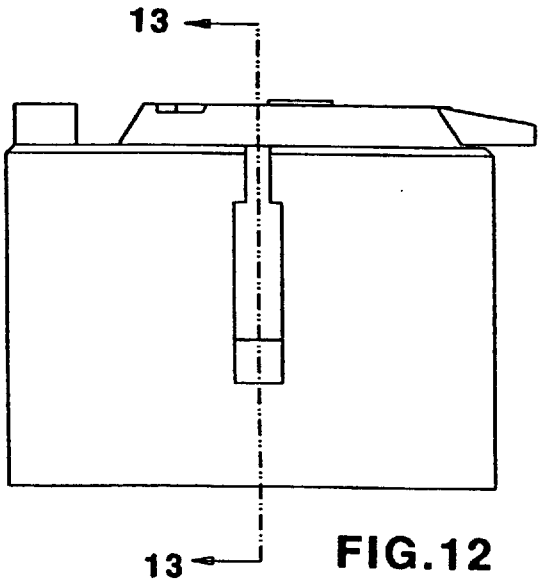
FIG. 12 is a side view of the FIG. 11 embodiment.
Figure 14B:
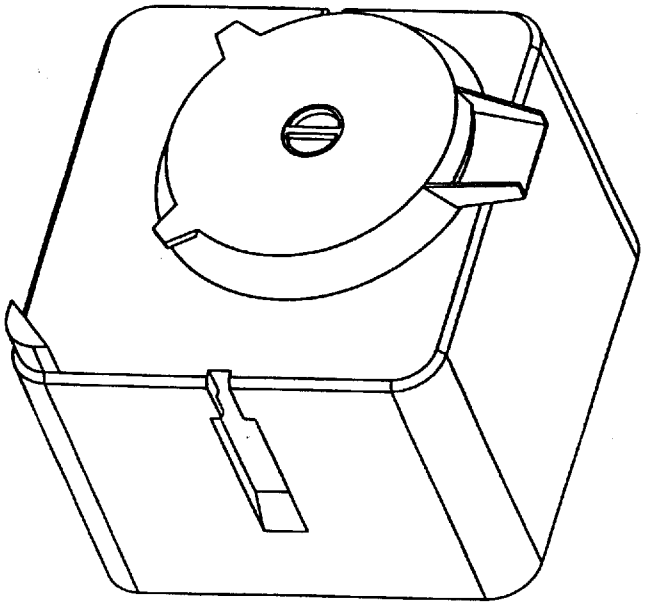
FIGS. 14 A and B are top and prospective views of the FIG. 11 can in its open position.
Figure 14A:
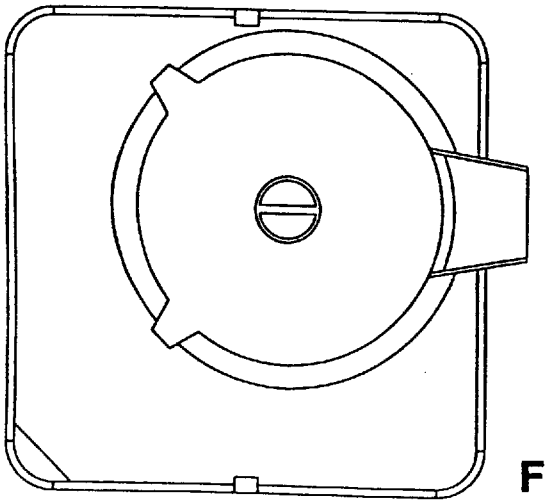
Figure 15B:
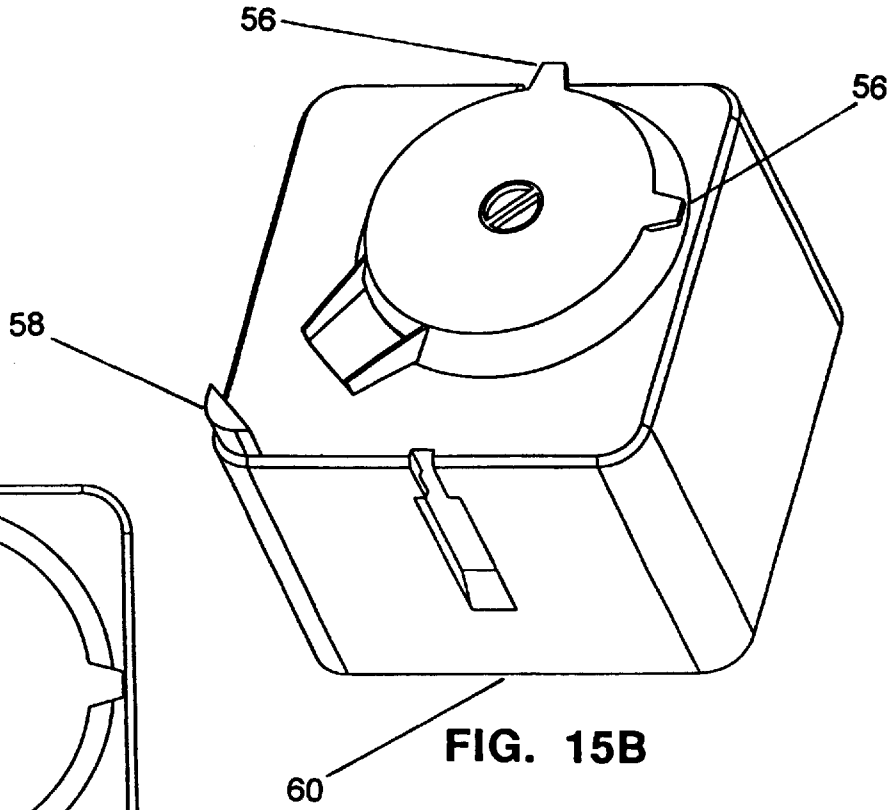
FIGS. 15 A and B are top and prospective views of the FIG. 11 can in its closed position.
Figure 15A:
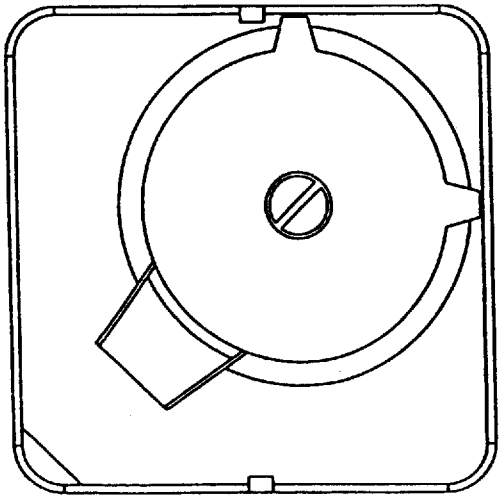

A second preferred embodiment of the present invention can be described by reference to FIGS. 11 through 15. This embodiment is very similar to the first preferred embodiment described above; however, for this embodiment the pour valve is integrated into the large cap. An exploded view of the paint can is shown in FIG. 11. Large cap 50 is designed with the same features as the pour valve of the first embodiment. The base for the cap is molded as an integral part of the can body 52. Preferred differential dimensions and tolerances are similar to those specified above for the smaller pour valve, taking into consideration the larger size of the cap in this embodiment. (The degree of interference will preferably be somewhat greater for the larger caps, because internal pressure forces against the cap are greater.) The large cap 50 can be removed with a prying action, using a screw driver or similar tool when the user desires to dip a large brush directly into the paint in the can or if a suction device is being installed in the can. A small vent cap 54 is provided which may be a screw cap or pressure fitted into cap 50. FIGS. 12, 13 and 13A show some of the features of this second preferred embodiment. FIGS. 14 A and B show views of the paint can with the cap 50 in its open position and FIGS. 15 A and B show views of the can with the cap in its closed position. As shown in FIGS. 15 A and B cap ears 56 and top stacking stub 58 provide a three point frame work for stacking a large number of these paint cans making use of the bottom edge 60 shown in FIG. 13.

Other Embodiments

While the above description contains many specificities, the reader should not construe these as limitations on the scope of the invention, but merely as exemplifications of preferred embodiments thereof. Those skilled in the art will envision many other possible variations are within its scope. For example the lids shown can be used on many sizes other than one gallon. The shape of the bottom of the can does not have to be square. Other rectangular shapes would provide most of the advantages of the square shape. They would work very well at the sizes specified on, for example, five gallon cans. On cans substantially smaller than one gallon such as one quart, sizes of course would be reduced. Many materials could be substituted for the plastic material specified. Some paint suppliers may prefer to have a knock out or screw opening in the the diaphragm or the straight edge part of the main opening for color mixing rather as an alternative to adding color through the vent opening. A permanent or removable flat plastic strap-type handle to assist carrying and pouring can be attached to sides of can in the slot shown on the side of the can in FIG. 11 so as to not interfere with stacking and screw cap removal. A hand grip could be molded into the body of the can. Accordingly, the reader is requested to determine the scope of the invention by the appended claims and their legal equivalents, and not by the examples that have been given.

We claim:

1. A can for holding paint and similar products comprising:

A) a can body having a substantially rectangular bottom and four substantially rectangular sides and a first circular opening in the top having a diameter larger than 5 inches, B) a cap covering said first circular opening and comprising a pour valve, wherein said pour valve defines at least ore open position and at least one closed position for permitting the contents of said can to be poured out of said valve opening when said valve is in one of said at least one open position and preventing pouring from said opening when said valve is in said at least one closed position, said pour valve means comprising a swivel nozzle defining a nozzle pour end swivelly positioned over said valve opening such that in at least one of said at least one valve open positions said nozzle pour end extends beyond at least on of said rectangular sides and in at least one of said at least one valve closed positions said nozzle end does extend beyond none of said rectangular sides, wherein 1) said sides of said can body extend beyond the bottom of said can body defining an extended bottom edge, 2) said pour valve covering said first opening further comprises two ears, 3) said can body further comprises a top stacking stub, wherein said ears and said stub being positioned to provide a three-point frame work matched to said bottom edge to facilitate stacking of said plurality of cans.

2. A can as in claim 1 wherein said pour valve comprises a pour valve cap comprising a snap ring and said attachment means comprises a ring seat configured to tightly mate with said snap ring.

3. A can as in claim 1 and further comprising a vent means for relieving any vacuum in the can when pouring.

4. A can as in claim 1 and further comprising a wiping means in said main opening for wiping excessive paint from paint brushes.

5. A can as in claim 4 wherein said wiping means is a straight edge.

6. A can as in claim 1 wherein said can is comprised of plastic.

7. A can as in claim 6 wherein said plastic is polyethylene.

8. A can as in claim 1 and further comprising removable diaphragms covering said first circular opening and said valve opening.

9. A can as in claim 1 wherein said rectangular bottom is a square bottom.

* * * * *